United States Patent [19]

Stine

[11] 4,244,302

[45] Jan. 13, 1981

[54] DOOR MOUNTING AND OPERATING APPARATUS FOR SECURITY TRANSACTION ENCLOSURES AND THE LIKE

[75] Inventor: James G. Stine, Allentown, Pa.

[73] Assignee: Automatic Devices Company, Allentown, Pa.

[21] Appl. No.: 76,731

[22] Filed: Sep. 18, 1979

[51] Int. Cl.[3] ..... E05G 5/02

[52] U.S. Cl. ..... 109/2; 109/48; 109/59 T; 109/73; 49/41

[58] Field of Search ..... 49/40, 41; 109/2, 4, 109/7, 59 T, 48, 73; 312/305

[56] References Cited

U.S. PATENT DOCUMENTS

| | | | |
|---|---|---|---|
| 2,081,271 | 5/1937 | Ellithorpe | 109/7 |
| 3,046,914 | 7/1962 | Sa ndberg | 109/5 |
| 3,370,380 | 2/1968 | Petros | 49/40 |
| 4,121,523 | 10/1978 | Hastings | 109/5 X |

*Primary Examiner*—Kenneth Downey
*Attorney, Agent, or Firm*—Mason, Fenwick & Lawrence

[57] ABSTRACT

A mounting and operating assembly for a movable closure or door of a transaction security booth or enclosure or the like having an upright cylindrical configuration, including an angle-iron shaped cross-section mounting ring having an inwardly projecting horizontal flange to be secured to the top portion of the enclosure by circumferentially spaced fastening bolts, a double I-beam shaped track secured to the ring by bolts through the flange having a pair of cable idler wheels on each, a T-shaped carrier at plural locations above the closure secured to the latter and having pairs of roller wheels riding on the bottom flange of the track, a drive motor and worm gear box supported on the ring having a horizontal axis wheel driving a cable system trained about a pair of horizontal axis idler wheels and about the cable idler wheels defining the cable path and secured to at least one of the carriers to open and close the closure.

14 Claims, 8 Drawing Figures

DOOR MOUNTING AND OPERATING APPARATUS FOR SECURITY TRANSACTION ENCLOSURES AND THE LIKE

BACKGROUND AND OBJECTS OF THE INVENTION

The present invention relates in general to movable closure or shield structures for regulating access to a security enclosure, and more particularly to apparatus or structure for mounting and electrically or manually moving and locking one or more access doors or enclosure shielding members for a secuity receptacle such as a transaction security booth or the like of the type typified by U.S. Pat. No. 4,121,523.

Heretofore, various structures have been developed in an effort to provide improved security for transactions involving transfer, exchange or deposit of valuables, particularly in connection with bank deposits, payroll transactions, tax collection and ticket office installations, and similar activities. One of the more recent systems devised to improve security and accuracy in such transaction facilities is the transaction security booth structure of the type shown in U.S. Pat. No. 4,121,523. This transaction security booth structure is provided with a door or closure shield regulating access to an entrance to a generally cylindrical booth together with control means for the door or closure shield. The interior of the booth, which may be referred to as the "transaction processing center", may contain electronic data processing apparatus, transaction processing equipment or other devices, and in some forms may have a second closure or door means controlling the access to the processing center. The booth is constructed to be capable of selective voluntary entry and involuntary detention of persons within the booth and preferably enables maintenance of an environment control as to temperature and humidity and similar environmental properties to facilitate proper operation of the data processing equipment. The door or closure shield in one form is arcuately shaped in horizontal section and extends circumferentially about substantially half or 180° of the booth and is movable about a common vertical center axis forming the center axis for the cylindrical booth, to control passage or access into and out of the booth. In another form, two doors each extending 90° may be used.

An object of the present invention is the provision of the mounting and operating system for an outer transparent enclosure shield or entrance door for a transaction security booth, for example of the type described in U.S. Pat. No. 4,121,523, wherein the mounting and operating system or structure is self-contained and capable of being attached in its entirety to the booth to facilitate assembly, disassembly and mobility of the booth, and which provides efficient and effective means of attaching and electrically or manually moving and locking the outer shield or door. A system embodying the same concepts may be also used for mounting and operating an inner door or movable closure for a similar security booth or security enclosure structure having inner door access control for the booth interior.

A further object of the invention is the provision of apparatus as described in the preceding paragraph, wherein the door operating mechanism is capable of being remotely controlled, and is able to stop or reverse automatically in the event that an object or person obstructs the movement of the door, and thus is able to prevent injury to a user of the booth.

Other objects, advantages and capabilities of the present invention will become apparent from the following detailed description, taken in conjunction with the accompanying drawings illustrating preferred embodiments of the invention.

DETAILED DESCRIPTION OF A PREFERRED EMBODIMENT

Figure 1:
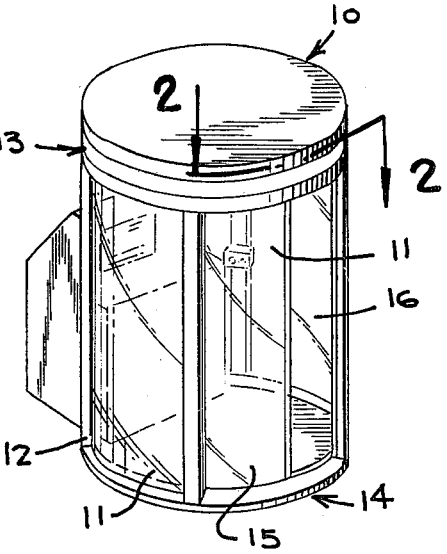
FIG. 1, is a perspective view of a transaction security booth having a movable enclosure shield or entrance door mounting and operating mechanism and structure embodying the present invention.

Referring to the drawings, wherein like reference characters designate corresponding parts throughout the several figures and particularly to FIGS. 1 to 5, inclusive, there is shown in FIG. 1 a typical transaction security booth, indicated by the reference character 10, which in this embodiment has its cylindrically curved side walls formed of panels, indicated at 11, for example of a material and construction capable of personnel retention, which is preferably transparent and is impact resistant to bullet and projectile impact and similar destructive forces. The panels 11 may be mounted within rigid vertical support members 12 secured near the periphery to the top or ceiling 13 of the booth and, if desired to the base or floor 14 to form an enclosure or housing. The entrance 15 to the booth 10 is bridged by a sliding outer enclosure shield, door or closure member 16, hereinafter usually called the outer entrance door, which is mounted on the track portion of the security shield mounting and operating assembly 17 forming the structural assembly of the present invention. In the preferred motorized embodiment, the outer entrance door forming the sliding security closure is driven by a motor and drive mechanism having a latching feature inherent in the drive mechanism such that the entrance door or closure can only be moved by operation of the motor, and which is controlled in such way that when the door is closed, it is secured and cannot be moved manually and reversal of the drive motor is required to open the door.

Figure 2:
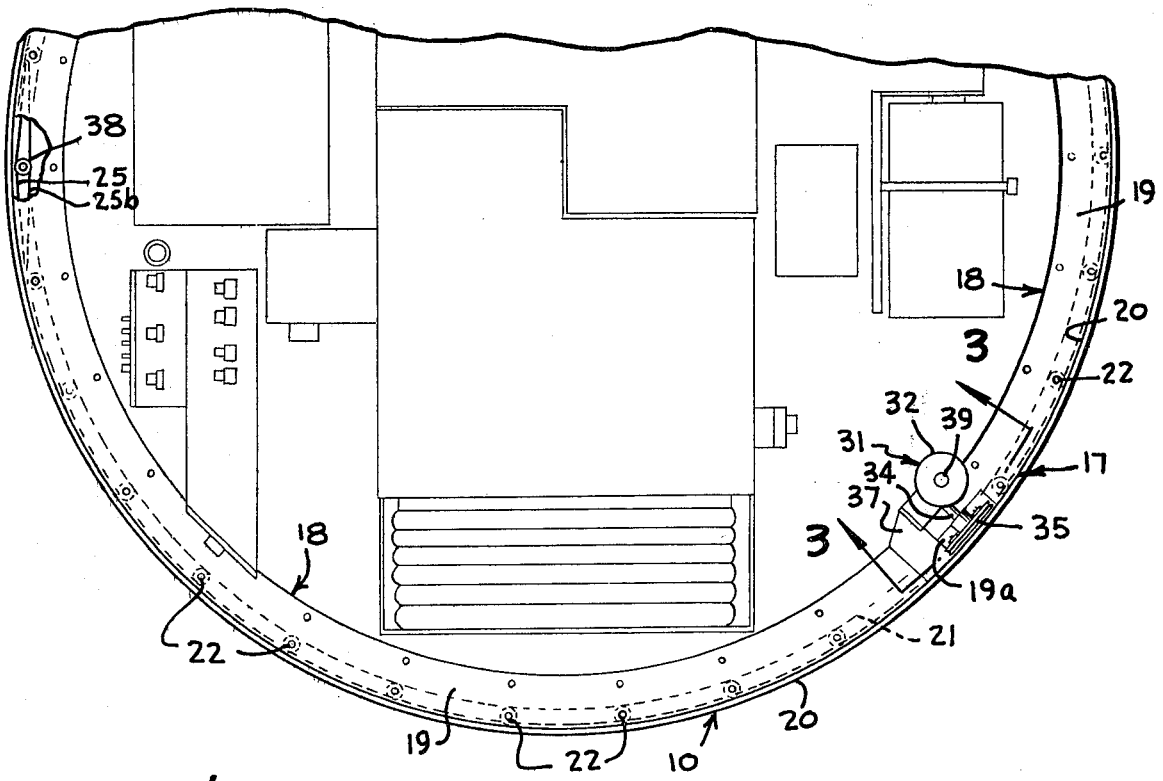
FIG. 2, is a fragmentary horizontal section view through the upper portion thereof, taken along the line 2—2 of FIG. 1.
Figure 4:
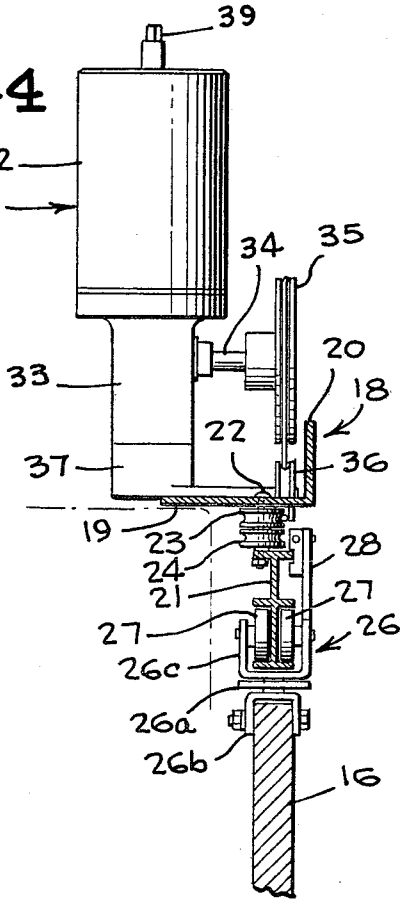
FIG. 4, is a vertical section view taken along the line 4—4 of FIG. 3.
Figure 3:
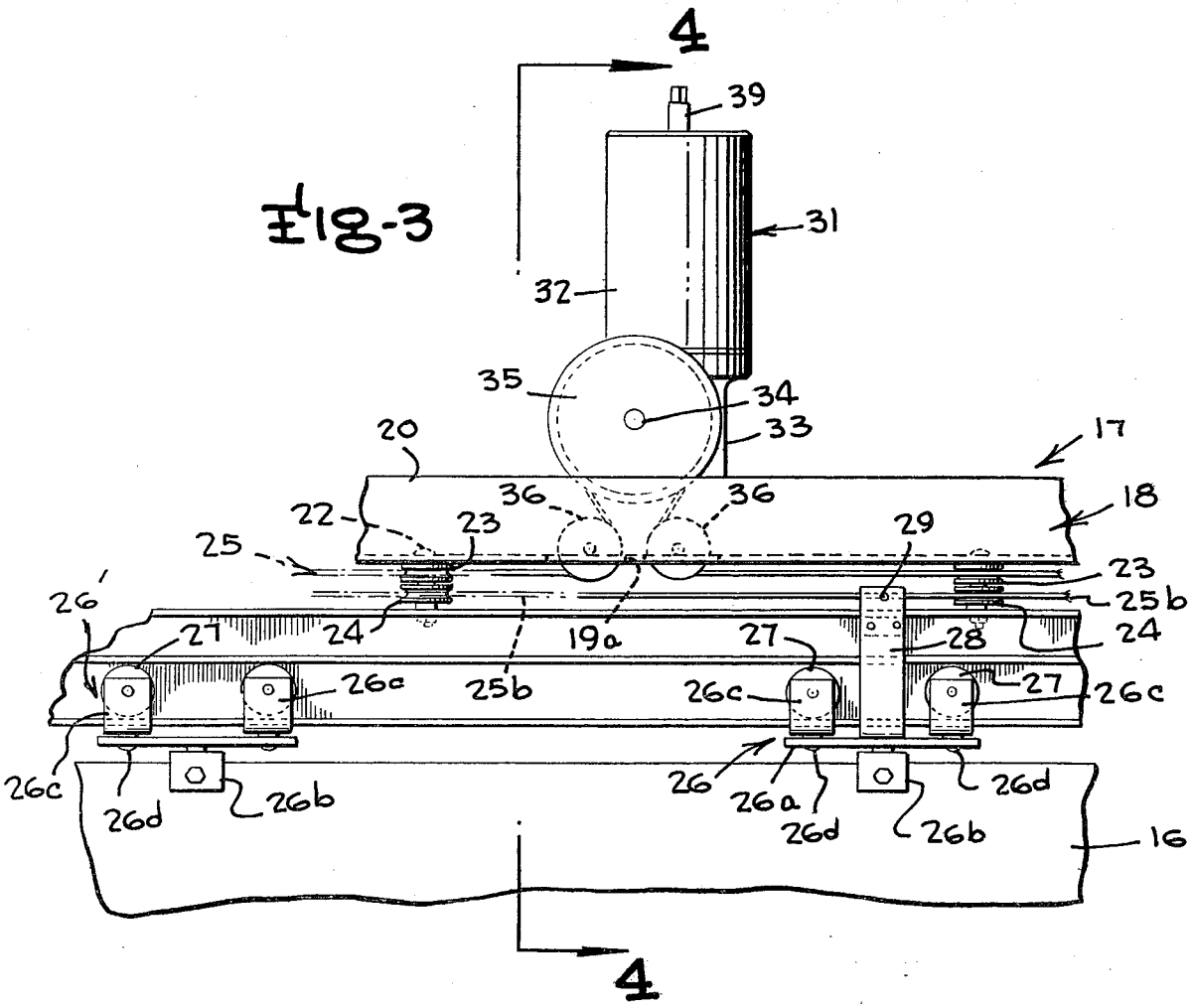
FIG. 3, is a fragmentary vertical section view of the door or shield mounting and operating structure, taken along the line 3—3 of FIG. 2.
Figure 5:
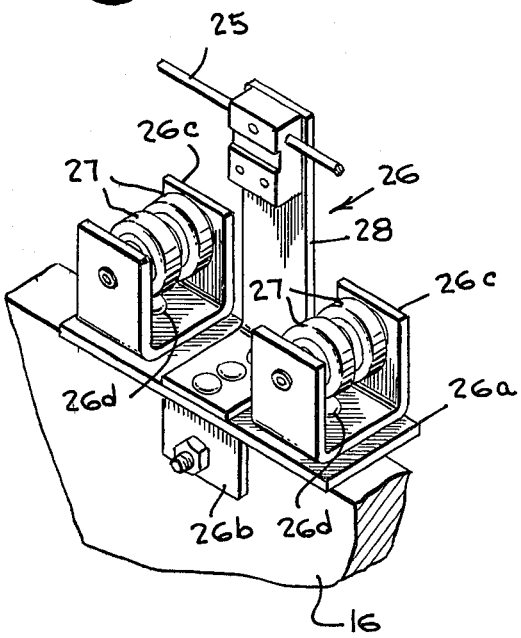
FIG. 5, is a perspective view of the door carrier member.

Referring more particularly to the details of construction of the entrance door mounting and operating assembly 17 illustrated in FIGS. 2, 3 and 4, comprises a main mounting ring 18 fabricated from angle metal curved to the shape and outside dimensions of the top or ceiling 13 of the security booth 10, providing an inwardly projecting circular bottom or horizontal flange 19 and a rising vertical flange 20. For example, the mounting ring 18 may be a 3 inch by 2 inch by ¼ inch aluminum angle ring having an outer diameter of about 62 inches and an inner diameter of about 56 inches, to be secured to the top or ceiling 13 of the booth by a large number of bolts extending through the horizontal flange 19 of the mounting ring, or by other suitable means of attachment. To this angle mounting ring 18 is attached a curved double I-beam track assembly 21 having top, bottom and intermediate flanges, which supports and guides the movement of the outer entrance door or security shield 16. In the preferred embodiment, the door track is secured to the mounting ring 18 by 30 bolts, indicated at 22, equally spaced on a 60 inch diameter circle, with each bolt 22 passing through two horizontal cable idler wheels 23,24 located between the I-beam track member 21 and the horizontal flange 19 of the mounting ring 18 from which the track is supported. This provides an extremely compact and efficient structure for locating and guiding the operating cable or cord system 25, which passes around the track path in the manner hereinafter described.

The entrance door or doors 16 in the illustrated embodiment is a cylindrically curved door spanning approximately a half circle or 180° and is supported from the track 21 by carrier members 26 which are bolted or suitably fastened to or through the top of the associated entrance door 16. A pair of the carrier members 26 are secured to the door near each opposite end of the door, in the illustrated embodiment, and are of generally inverted T-shaped configuration in side elevation having a bottom plate **26*a* fixed to the door 16 by a depending U-bracket 26*b* pivotally secured to plate 26*a* about a vertical pivot axis and bolted to the door. A pair of upwardly projecting yokes or U-shaped brackets 26*c* are mounted on plate 26*a* by vertical pivot connections 26*d* and carry nylon ball bearing wheels or rollers 27 which roll along the bottom flange of the double I-beam track 21 and are located to flank the vertical web portion of the track. Each of these endmost carrier members 26 have an upright vertical attachment arm 28 to which the operating cable 25 is secured by a set screw as indicated at 29. Similar carrier members 26' without the upright arm 28 are attached to the door at a suitable number of points, for example three or more, between the endmost carrier members 26** to give proper support for the door.

The motor drive mechanism for operating the cable system and driving the door is in the form of a compact, high-torque motor and worm gear unit generally indicated at 31 including the drive motor 32 and right-angle worm gear box 33 for translating the rotation of the vertical motor shaft of the motor 32 to a horizontal drive wheel shaft 34 having a drive wheel 35 thereon rotatable about a horizontal axis. Two vertical cable idler wheels 36 rotatable about spaced parallel horizontal axes are journaled on suitable stub shafts extending from the base 37 of the motor and worm gear unit 31 and extend through a slot **19*a* or plural openings cut through the horizontal flange 19 of the mounting ring 18 to bring the operating cable 25 up from the track level and over the drive wheel 35 driven by the motorized gear unit. The series of equally spaced cable idler wheels 23 and 24 placed one above the other horizontally over the mounting bolts at each track attachment bolt 22 for the track 21 guide the operating cable 25 around the track 21. One stack of two vertically spaced horizontal dead-end cable return idler wheels 38 like the idler wheels 23 and 24, are placed over a track mounting bolt at the return points of the cable, for example at about a 9 o'clock position along the track as indicated in FIG. 2, and one cable portion is trained 180° around the upper return idler wheel 38 and the other about the lower idler wheel of the associated stack and the cable portions return along the lower path indicated at 25*b* to be attached at each end to the vertical arm 28 of one of the carrier members 26 by its set screw 29**.

The motor and worm gear unit 31 is capable of being stopped, started and reversed by conventional electrical circuitry readily apparent to persons ordinary skilled in the relevant art.

By virtue of the inherent self-locking nature of the right-angle worm gear drive provided at the worm gear box 33, the outer entrance door or shield 16, becomes locked in place when the operating power is disconnected or switched off from the motor 32 by any conventional electrical limiting device. In case of power failure, the system can be manually overridden and the door or doors opened by rotating the motor shaft extension 39 by hand. The motor and worm gear unit assembly and associated mechanism may be incorporated in the top portion of the booth and access may be provided by top cover panels on the booth structure for servicing, repair or replacement of the motor drive mechanism.

Figure 6:
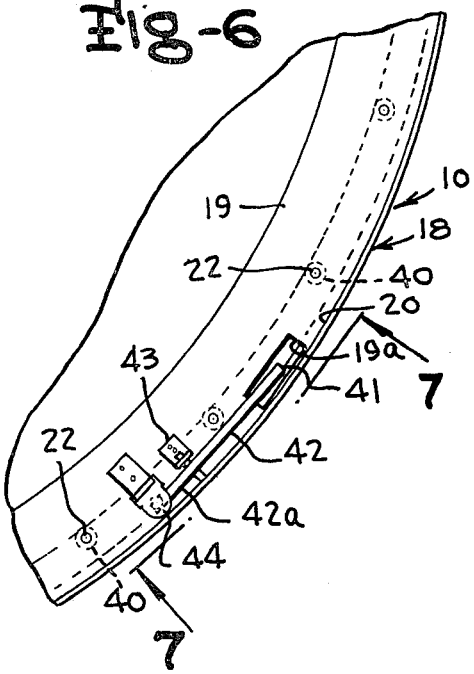
FIG. 6, is a fragmentary horizontal section view similar to FIG. 2, but showing the portion of the top angle ring support and solenoid and latch assembly and adjacent track structure for a manually operated embodiment.
Figure 7:
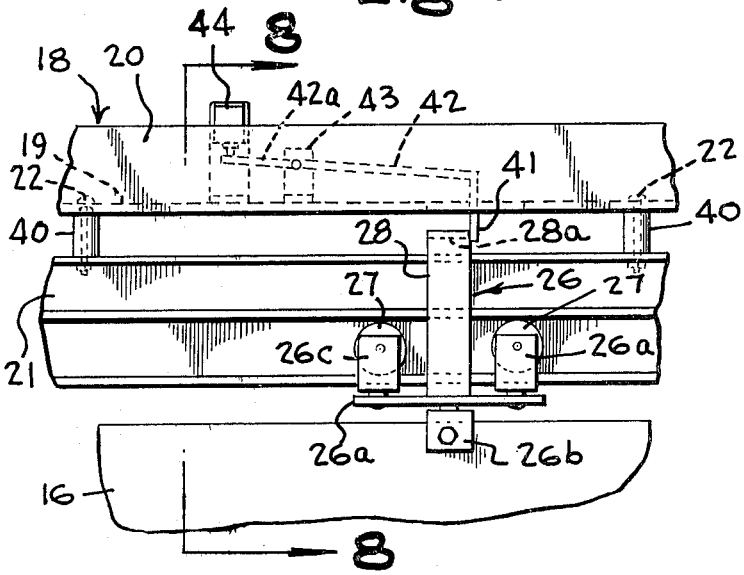
FIG. 7, is a fragmentary vertical section view of the FIG. 6 embodiment, taken along the line 7—7 of FIG. 6.
Figure 8:
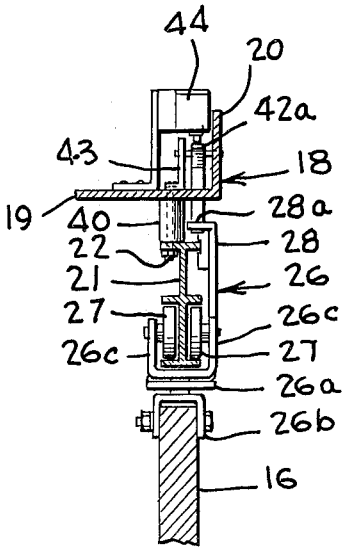
FIG. 8, is a fragmentary section view taken along the line 8—8 of FIG. 7.

An alternate arrangement is illustrated in FIGS. 6, 7 and 8, wherein the motor drive unit and cable system is eliminated and the entrance door or enclosure shield 16 is manually moved between open and closed positions, and is regulated by a solenoid operated latch mechanism. In this embodiment, wherein parts corresponding to those described in connection with the first embodiment of FIGS. 1–5 are identified by the same reference characters, the entrance door or encloure shield 16 for the booth is supported by carrier members 26 having a bottom plate **26*a* and roller brackets 26*c* carrying ball bearing wheels 27 which ride on the lower flanges of the I-beam track 21, as in the first described embodiment. Instead of employing a pair of cable idler wheels 23 and 24 on the track mounting bolts 22, cylindrical spacers 40 having a height corresponding substantially to that of the pair of cable idler wheels 23,24 and having a central bore sized to receive the shank of the bolt 22 is assembled onto the bolt between the top flange of the track 21 and the horizontal flange 19 of the mounting ring 18. The upwardly projecting cable attachment arm 28 in this embodiment, since no cable system is employed, includes an inwardly projecting top flange 28*a* which projects toward the center axis of the booth almost to the location of the spacers 40, to be located in the path of the latch foot 41 of the pivoted latch lever 42 pivotally supported by a bracket 43 mounted on the horizontal flange 19 of the mounting ring 18, and having an opposite upper end portion 42*a* engaged by the plunger of a push-type solenoid 44 suitably mounted on the mounting ring 18. The latching lever 42 in the lower position illustrated in FIG. 7 is located along the path of the track so as to position its latching foot 41 in the path of the top flange 28*a* of the cable attachment arm 28 of carrier member 26** when the door is in closed position to restrain the door in closed position under control of the access control circuitry of the booth in the manner, for example, disclosed in said U.S. Pat. No. 4,121,523.

I claim:

1. A closure mounting and operating assembly for a movable closure for the entrance passage of a security transaction booth or the like in the form of an upright cylindrical enclosure having a cylindrical top wall structure, the assembly comprising an angle-iron shaped main mounting ring having an inwardly projecting circular mounting flange to be fastened to said top wall structure adjacent the outer perimeter thereof concentric with the vertical center axis of the cylindrical enclosure, a circular track fixed in depending relation to said mounting ring concentrically below the same by fastening bolts extending from an upper portion of the track through said mounting flange, the track having an I-beam shaped cross-section portion having a vertical center web and a bottom track flange, supported from the flange by a plurality of circumferentially spaced bolts through the top of the track and said flange, a plurality of door carrier devices to be secured to the top portion of and dependently carry the movable closure each having two pairs of roller wheels flanking the web of the track at opposite sides thereof and riding on said bottom track flange at circumferentially spaced locations, a drive motor and worm gear box mounted on the mounting ring having a main drive wheel driven thereby rotatable about a horizontal axis, a pair of cable idler wheels rotatable about spaced parallel horizontal axes below said drive wheel and immediately below said mounting flange, a cable system trained about the drive wheel and cable idler wheels and extending outwardly around the track to substantially encircle the enclosure having attachment to at least one of said carrier devices to move the carrier devices and closure supported thereby in entrance opening and closing directions under control of the drive motor and worm gear box, and cable guide means assembled on said bolts between said bottom flange and the top of the track for guiding and locating the cable system.

2. A closure mounting and operating assembly as defined in claim 1, whereby said last-mentioned means is a vertically spaced pair of cable idler wheels mounted on each of said bolts at plural locations along each quadrant of the circular path immediately outwardly adjacent the track to engage and guide portions of the cable along to adjacent vertically spaced circular cable paths.

3. A closure mounting and operating assembly as defined in claim 1, wherein said track has a top horizontal track flange extending from said web above the bottom track flange, said bolts extending through said top horizontal track flange and said mounting flange and said cable guide means forming spacers for spacing the top track flange and said mounting flange a predetermined distance apart.

4. A closure mounting and operating assembly as defined in claim 2, wherein said track has a top horizontal track flange extending from said web above the bottom track flange, said bolts extending through said top horizontal track flange and said mounting flange and said pairs of cable idler wheels forming spacers for spacing the top track flange and said mounting flange a predetermined distance apart.

5. A closure mounting and operating assembly as defined in claim 1, wherein said track has a double I-beam configuration providing an intermediate horizontal flange and a top horizontal track flange extending from said web above the bottom track flange, said bolts extending through said top horizontal track flange and said mounting flange and said cable guide means forming spacers for spacing the top track flange and said mounting flange a predetermined distance apart.

6. A closure mounting and operating assembly as defined in claim 1, wherein said track has a top horizontal track flange extending from said web above the bottom track flange, said bolts extending through said top horizontal track flange and said mounting flange and said cable guide means forming spacers for spacing the top track flange and said mounting flange a predetermined distance apart, and the roller wheels of said carrier assemblies interfitting oppositely into outwardly facing channels defined between the intermediate and bottom track flanges.

7. A closure mounting and operating assembly as defined in claim 2, wherein said track has a double I-beam configuration providing an intermediate horizontal flange and a top horizontal track flange extending from said web above the bottom track flange, said bolts extending through said top horizontal track flange and said mounting flange and said pairs of cable idler wheels forming spacers for spacing the top track flange and said mounting flange a predetermined distance apart.

8. A closure mounting and operating assembly as defined in claim 2, wherein said track has a top horizontal track flange extending from said web above the bottom track flange, said bolts extending through said top horizontal track flange and said mounting flange and said pairs of cable idler wheels forming spacers for spacing the top track flange and said mounting flange a predetermined distance apart, and the roller wheels of said carrier assemblies interfitting oppositely into outwardly facing channels defined between the intermediate and bottom track flanges.

9. A closure mounting and operating assembly as defined in claim 1, wherein said carrier assembly comprises a horizontal elongated base plate having a vertically rising center arm for attachment to the cable system and a pair of upwardly opening U-shaped yoke members pivoted about vertical axes on said base plate spaced toward opposite ends thereof from said center arm and having stub shafts journalling a pair of said roller wheels in each yoke member.

10. A closure mounting and operating assembly as defined in claim 2, wherein said carrier assembly comprises a horizontal elongated base plate having a vertically rising center arm for attachment to the cable system and a pair of upwardly opening U-shaped yoke members pivoted about vertical axes on said base plate spaced toward opposite ends thereof from said center arm and having stub shafts journalling a pair of said roller wheels in each yoke member.

11. A closure mounting and operating assembly as defined in claim 4, wherein said carrier assembly comprises a horizontal elongated base plate having a vertically rising center arm for attachment to the cable system and a pair of upwardly opening U-shaped yoke members pivoted about vertical axes on said base plate spaced toward opposite ends thereof from said center arm and having stub shafts journalling a pair of said roller wheels in each yoke member.

12. A closure mounting and operating assembly as defined in claim 6, wherein said carrier assembly comprises a horizontal elongated base plate having a vertically rising center arm for attachment to the cable system and a pair of upwardly opening U-shaped yoke members pivoted about vertical axes on said base plate spaced toward opposite ends thereof from said center arm and having stub shafts journalling a pair of said roller wheels in each yoke member.

13. A closure mounting and operating assembly as defined in claim 7, wherein said carrier assembly comprises a horizontal elongated base plate having a vertically rising center arm for attachment to the cable system and a pair of upwardly opening U-shaped yoke members pivoted about vertical axes on said base plate spaced toward opposite ends thereof from said center arm and having stub shafts journalling a pair of said roller wheels in each yoke member.

14. A closure mounting and operating assembly as defined in claim 8, wherein said carrier assembly comprises a horizontal elongated base plate having a vertically rising center arm for attachment to the cable system and a pair of upwardly opening U-shaped yoke members pivoted about vertical axes on said base plate spaced toward opposite ends thereof from said center arm and having stub shafts journalling a pair of said roller wheels in each yoke member.

* * * * *